US006988823B2

(12) United States Patent
Wilson

(10) Patent No.: US 6,988,823 B2
(45) Date of Patent: Jan. 24, 2006

(54) APPARATUS AND METHOD FOR WETTING POWDER

(75) Inventor: Stephen Wilfred Wilson, Harden (GB)

(73) Assignee: Ciba Specialty Chemicals Corp., Tarrytown, NY (US)

( * ) Notice: Subject to any disclaimer, the term of this patent is extended or adjusted under 35 U.S.C. 154(b) by 65 days.

(21) Appl. No.: 10/475,477

(22) PCT Filed: Apr. 30, 2002

(86) PCT No.: PCT/EP02/04743

§ 371 (c)(1),
(2), (4) Date: Oct. 20, 2003

(87) PCT Pub. No.: WO02/092206

PCT Pub. Date: Nov. 21, 2002

(65) Prior Publication Data

US 2004/0136262 A1 Jul. 15, 2004

(30) Foreign Application Priority Data

May 14, 2001 (GB) ..... 0111704

(51) Int. Cl.
*B01F 7/16* (2006.01)
*B01F 15/02* (2006.01)

(52) U.S. Cl. ..... 366/163.2; 366/262; 366/307

(58) Field of Classification Search ..... 366/153.1, 366/163.2, 168.1, 171.1, 174.1, 181.4, 182.4, 366/262–265, 307, 315–317; 422/135, 224–228
See application file for complete search history.

(56) References Cited

U.S. PATENT DOCUMENTS 2,361,503 A * 10/1944 Schutte et al.
2,953,359 A 9/1960 Mau
3,013,866 A * 12/1961 Samaniego et al.
3,604,690 A * 9/1971 Traelnes
3,966,542 A * 6/1976 Oldshue
4,077,612 A * 3/1978 Ricciardi
4,483,624 A * 11/1984 Bacon et al.
4,642,222 A * 2/1987 Brazelton
4,747,691 A * 5/1988 Hoffland
4,750,994 A * 6/1988 Schneider
4,778,280 A * 10/1988 Brazelton
5,018,870 A * 5/1991 Brazelton et al.

(Continued)

FOREIGN PATENT DOCUMENTS

JP 550061929 5/1980

(Continued)

OTHER PUBLICATIONS

Derwent Abstract 1980-44019C for JP 550061929 (1980).

*Primary Examiner*—Charles E. Cooley

(74) *Attorney, Agent, or Firm*—Tyler A. Stevenson

(57) ABSTRACT

Disclosed is an apparatus for wetting particulate material comprising a tank (1) that has an outlet (2) at its lower end and an inlet (3) at its upper end, into which is mounted a container (4) comprising a number of individual internal chambers (5) having horizontal baffles (6) which each have an orifice (7), a stirring rod (8) which is substantially coaxial with the tank passes through each orifice, and one or more impeller(s) (9) and one or more collar(s) (10) are attached to the stirring rod above each orifice and the apparatus additionally comprises a hopper (11) connected to a feeding device (12) which in turn is connected to an eductor (13) that is coupled to a water supply (24) and the inlet.

8 Claims, 1 Drawing Sheet

U.S. PATENT DOCUMENTS 5,018,871 A * 5/1991 Brazelton et al.
5,061,456 A * 10/1991 Brazelton et al.
5,164,429 A * 11/1992 Brazelton et al.
5,174,651 A * 12/1992 Gaddis
5,252,635 A * 10/1993 Brazelton et al.
5,284,626 A * 2/1994 Brazelton et al.
5,284,627 A * 2/1994 Brazelton et al.
5,344,619 A * 9/1994 Larwick et al.
5,580,168 A * 12/1996 Alireza et al.
5,762,661 A * 6/1998 Kleinberger et al.
5,857,773 A * 1/1999 Tammelin
5,947,596 A * 9/1999 Dowd
5,951,161 A * 9/1999 Blagg
6,024,481 A 2/2000 Hillstrom et al.
6,039,470 A * 3/2000 Conwell
2004/0008571 A1 * 1/2004 Coody et al.
2004/0136262 A1 * 7/2004 Wilson
2005/0024988 A1 * 2/2005 Hoff et al.

FOREIGN PATENT DOCUMENTS

JP 4-141226 * 5/1992

* cited by examiner

APPARATUS AND METHOD FOR WETTING POWDER

This invention relates to an apparatus and method for wetting powdered material, especially polymeric powdered material, so as to promote subsequent uniform distribution of the wetted material throughout bulk water.

It is well known that it can be difficult to dissolve water soluble powdered material quickly in water without forming lumps of aggregated partially dissolved material, often called fish-eyes.

Numerous mixing devices have been proposed with the aim of converting dry, substantially friable, particulate material into a uniform dispersion or solution in water.

EP0686060 provides apparatus for uniformly wetting water soluble or water swellable particulate material comprising a substantially vertical wetting duct that is open at its lower end and that has at its upper end a duct inlet that is substantially coaxial with the duct and that is defined by inlet walls, and through which the material can be fed to the duct, weir means extending around the top of the inlet walls, and means for providing a substantially continuous flow of water over the weir means and down along substantially the entire exposed surface of the inlet walls, and water spray orifices positioned substantially around the duct inlet and arranged to direct sprays of water downwardly through the duct to wet the particulate material. The apparatus is used batch wise, so amounts of polymer may not be wetted continuously.

It is an object of the invention to provide a simple apparatus and method for uniformly wetting water soluble or water swellable particulate material so as to permit that material to be dissolved or uniformly dispersed in bulk dilution water with minimum formation of fish-eyes, whilst maintaining a low level of build-up of solid material in the apparatus and allowing the apparatus to be used in-line, in other words allowing the wetted powder to be continuously removed from the apparatus as it is being wetted.

BRIEF DESCRIPTION OF THE DRAWING

The apparatus for wetting powdered material is shown in FIG. 1.

The invention provides an apparatus comprising a tank (1) that has an outlet (2) at its lower end and an inlet (3) at its upper end, into which is mounted a container (4) comprising a number of individual internal chambers (5) having horizontal baffles (6) which each have an orifice (7), a stirring rod (8) which is substantially coaxial with the tank passes through each orifice, and one or more impeller(s) (9) and one or more collar(s) (10) are attached to the stirring rod above each orifice and the apparatus additionally comprises a hopper (11) connected to a feeding device (12) which in turn is connected to an eductor (13) that is coupled to a water supply (24) and the inlet.

Figure 1:
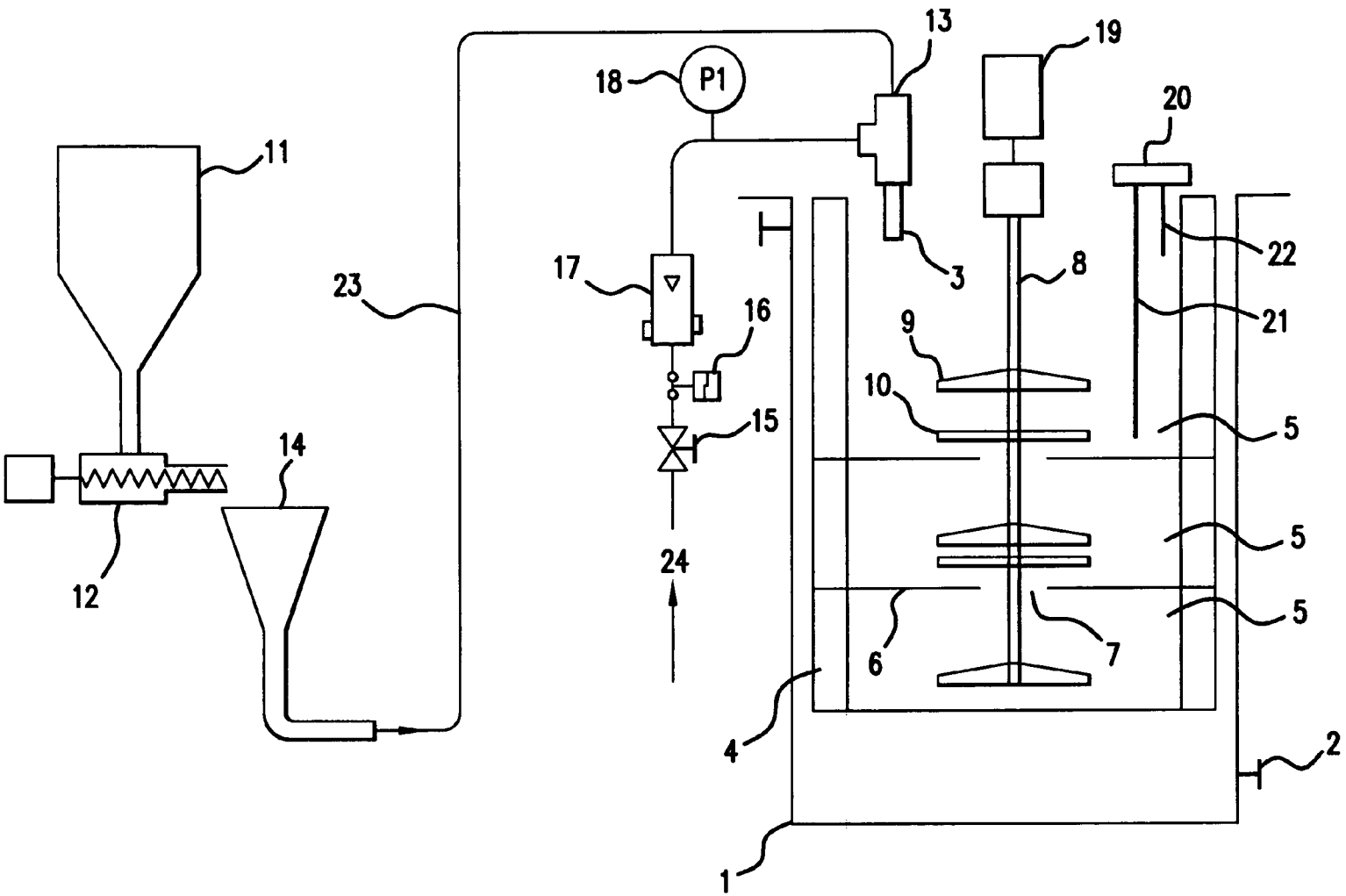

Preferably the tank (1) is substantially upright with respect to the surface the apparatus is placed upon. The inside wall of the container (4) within each chamber (5) may also act as a baffle.

The container (4) and the other parts of the apparatus contained therein, may be easily removed from the tank (1) so the tank may be easily replaced with a tank of a different diameter and depth.

The number of individual internal chambers (5) may be one or more, preferably more than two, more preferably more than three. An apparatus containing three chambers is of particular use. The impellers are of a suitable design, such as the A310 type impeller.

The collar (10) is preferably attached to the stirring rod above the orifice but below the impeller. Preferably there exists a gap between the collar and the baffle, allowing the water to flow downwards through the orifice into the adjacent internal chamber.

The hopper is of a suitable capacity, for example in the range of 50 kg to 150 kg.

The feeding device may be a device which is suitable for use with particulate material, such as a screwfeeder. The feeding device (12) may be connected to the eductor (13) via a suitable channel, such as a funnel (14) and a connecting pipe (23)

The water supply may be fed into the eductor via a control system comprising of a flow regulating valve (15), an electrically operated valve such as a solenoid valve (16), a gauge suitable for measuring the flow of water, such a as a rotameter (17) and a pressure gauge (18).

The stirring rod may be rotated by suitable means, such as a motor (19).

A system of level electrodes (20) may be placed in the topmost chamber of the container (4). Such a system preferably comprises of a low level electrode (21) and a high level electrode (22). The positions of the electrodes may be altered accordingly depending on how the apparatus is operated.

Preferably the apparatus is used for wetting particulate material, more preferably it is used for wetting polymeric particulate material. Particulate material may include powders.

The apparatus is preferably of a compact design, so that a minimum of space is required for its installation. The apparatus also involves very little operator involvement, and is substantially automated.

The particulate materials for which the invention is useful are generally polymeric materials. They can be water-soluble polymers, in which event the wetted polymer particles will subsequently be added to water to form a solution, or they can be water-swellable but also water-insoluble particles in which event the wetted particles will form a uniform suspension upon addition to water.

The preferred particulate materials are water soluble polymers having a particle size with at least 90%, and usually at least 99%, by weight in the range 20 to 1000 microns.

At least 80%, and usually at least 90%, by weight of the particulate material usually has a particle size below 700 microns, frequently below 400 microns.

The particulate material can be a natural polymer such as a starch or cellulose but preferably is a synthetic polymer made by polymerisation of water-soluble monomers, optionally with a cross-linking agent if the polymer is to be swellable and insoluble. The monomers can typically be acrylamide or other non-ionic monomers, sodium acrylate or other anionic monomers, and dialkylaminoalkyl(meth) acrylate or -acrylamide acid addition or quaternary salts or other cationic monomers. Polymers such as those referred to as flocculants in the industry may be wetted out using the current apparatus.

A further aspect of the invention is a method of uniformly wetting particulate material using an apparatus as described above comprising feeding the particulate material from the hopper (11) to the feeding device (12) then into the inlet (3) while feeding water into the eductor (13) and through the inlet (3).

Particulate material is fed by the feeding device (12) at a rate of 0.05 to 0.5 kg per minute, for example 0.2 kg per minute, while water is pumped through the eductor (3) at a rate of about 40 liters per minute under a pressure of 20 to 60 psi. The vacuum created by the flow of water through the eductor will draw the dry polymer through the apparatus into the inlet. The flow of water may be adjusted to give a sufficient vacuum, for example about 30 inches Hg.

The rates at which the particulate material and water is fed into the tank may be altered depending upon how the apparatus is used. The amount of water and amount of particulate material being fed into the tank is controlled by the system of level electrodes, which electronically controls the valve (16) and feeding device (12). A preferred system of operation is described below:

The flow regulating valve (15) is adjusted to give a suitable flow of water. When the water level in the tank (1) falls below the low level electrode (21) the valve (16) opens and water is fed in to the eductor (13). As the valve is opened, polymer powder is fed from the hopper (11) into the cone (14) via the feeding device (12) at a metered rate. The water passing through the eductor (13) into the tank (1) creates a vacuum which draws the powder into the eductor (13) and wets it out into the tank.

When the level in the tank reaches the high level electrode (22), the feeding device (12) stops and after a set time the valve (16) shuts. This set time may be adjusted in order to provide the desired final concentration of the solution. When the level in the tank falls below the low level electrode again the cycle restarts. While the unit is running, the stirring rod (8) runs continuously and fully aged polymer is always available at the outlet of the tank.

The solution concentrations produced by the current method may vary according to the method of operation, for example concentrations of from 0.2% to 0.5% may be achieved.

The following examples further illustrate the invention.

EXAMPLE 1

A high molecular weight anionic polyacrylamide flocculant was added to the top tank via an eductor which was fed by a screw feeder at a rate of 200 g per minute. The eductor was coupled to a water supply being fed at a rate of 2.4 $m^3$/hr, giving an approximate solution concentration of 0.5%. The flocculant solution was pumped from the outlet of the unit at a rate of 2 $m^3$/hr.

The unit was initially filled with water to just above the impeller in the top chamber and the stirrer rod started. A blue dye was added to the water to give a deep blue coloration. The pump and the water addition were started and the time taken for the water to turn the same shade of blue as the top tank was noted. The tank was then drained.

The unit was again filled with water to just above the impeller in the top tank and the stirrer started. Dry flocculant and water were added and the pump started. A sample of the flocculant solution being pumped from the bottom of the tank was taken for evaluation. When the concentration of the flocculant solution being pumped from the bottom of the tank was equivalent to the starting concentration, a blue dye was added to the water to give a deep blue coloration. Again, the time taken for the water to turn the same shade of blue as the top tank was noted. The tank was then drained.

Time taken for dye to pass completely through unit containing water was fifteen minutes. Time taken for dye to pass completely through unit containing flocculant solution was forty minutes.

Three different types of flocculant solution were prepared, one type prepared by standard laboratory methods, one type taken from the apparatus outlet and one type extracted from the top of the tank.

Various flocculant solutions were prepared by using the apparatus described herein and removing the solution from the outlet. Different sample times (amount of time the solution was mixed) provided solutions of varying dry weight concentrations. The performance of each flocculant solution prepared was measured by standard procedures using 4% 2 g/l sodium chloride china clay. Varying dose levels provided varying settlement rates as shown in Table 1.

TABLE 1

| Product | Sample Time (mins) | Solution Dry Weight (%) | Dose Level (mls) | Settlement Rate (cm/min) |
|---|---|---|---|---|
| Standard Laboratory Prepared Flocculant | — | 0.43 | 0.25 | 3.5 |
| | | | 0.5 | 20.1 |
| | | | 0.75 | 71.1 |
| Flocculant - solution taken from Outlet | 15 | 0.07 | 1 | <1 |
| | 30 | 0.14 | 1 | 1.7 |
| | 45 | 0.23 | 0.75 | 2.9 |
| | | | 1 | 8.6 |
| | 60 | 0.28 | 0.75 | 8.7 |
| | | | 1 | 13.4 |
| | 75 | 0.33 | 0.75 | 11.1 |
| | | | 1 | 46.8 |
| | 90 | 0.39 | 0.5 | 6.6 |
| | | | 0.75 | 36.4 |
| | 105 | 0.41 | 0.5 | 14.3 |
| | | | 0.75 | 44.2 |
| | 120 | 0.41 | 0.5 | 15.3 |
| | | | 0.75 | 55.4 |
| | 135 | 0.44 | 0.5 | 16.6 |
| | | | 0.75 | 57.7 |
| | 150 | 0.44 | 0.5 | 18.6 |
| | | | 0.75 | 60.4 |
| Flocculant - solution taken from top of tank | 150 | 0.44 | 0.25 | 2.2 |
| | | | 0.5 | 15.1 |
| | | | 0.75 | 53.6 |

The results of the rate of dye mixing evaluation show that the dye mixes in with the water over twice as fast as the dye in the polymer solution. Both of these results indicate that the mixing within the unit is good, with the polymer solution passing well between the three internal mixing tanks.

The results of the flocculant solution evaluation indicate that the flocculant solution achieves the correct concentration after approximately 135 minutes.

The invention claimed is:

1. An apparatus for wetting particulate material comprising a tank (1) that has an outlet (2) at its lower end and an inlet (3) at its upper end, into which is mounted a container (4) comprising a number of individual internal chambers (5) having horizontal baffles (6) which each have an orifice (7), a stirring rod (8) which is substantially coaxial with the tank passes through each orifice, and one or more impeller(s) (9) and one or more collar(s) (10) are attached to the stirring rod above each orifice and the apparatus additionally comprises a hopper (11) connected to a feeding device (12) which in turn is connected to an eductor (13) that is coupled to a water supply (24) and the inlet.

2. An apparatus according to claim 1 wherein the number of individual internal chambers (5) is one or more.

3. An apparatus according to claim 1 wherein the collar (10) is attached to the stirring rod above the orifice but below the impeller.

4. An apparatus according to claim 1 wherein there exists a gap between the collar and the baffle.

5. An apparatus according to claim 1 wherein the water supply is fed into the eductor via a control system comprising a flow regulating valve (15), an electrically operated solenoid valve (16), a rotameter gauge suitable for measuring the flow of water (17) and a pressure gauge (18).

6. An apparatus according to claim 1 wherein a system of level electrodes (20) is placed in the topmost chamber of the container (4), comprising a low level electrode (21) and a high level electrode (22).

7. An apparatus according to claim 1 wherein the particulate materials are water soluble polymers having a particle size with at least 90% by weight in the range 20 to 1000 microns.

8. A method of wetting particulate material using an apparatus according to claim 1 comprising feeding the particulate material from the hopper (11) to the feeding device (12) then into the inlet (3) while feeding water into the eductor (13) and through the inlet (3).

* * * * *

UNITED STATES PATENT AND TRADEMARK OFFICE

CERTIFICATE OF CORRECTION

PATENT NO. : 6,988,823 B2
APPLICATION NO. : 10/475477
DATED : January 24, 2006
INVENTOR(S) : Stephen Wilfred Wilson It is certified that error appears in the above-identified patent and that said Letters Patent is hereby corrected as shown below:

Title page

Section [73] should read:

(73) Assignee: Ciba Specialty Chemicals Water Treatments Limited,
West Yorkshire, UNITED KINGDOM Signed and Sealed this Twelfth Day of September, 2006

JON W. DUDAS
*Director of the United States Patent and Trademark Office*